US005540444A

United States Patent [19]

Nguyen

[11] Patent Number: 5,540,444

[45] Date of Patent: Jul. 30, 1996

[54] METHOD OF PLAYING A CARD GAME

[76] Inventor: Son H. Nguyen, 11052 Stonecress, Fountain Valley, Calif. 92708

[21] Appl. No.: 376,402

[22] Filed: Jan. 23, 1995

[51] Int. Cl.[6] ..... A63F 1/00

[52] U.S. Cl. ..... 273/292; 273/306

[58] Field of Search ..... 273/292, 274, 273/309, 306

[56] References Cited

U.S. PATENT DOCUMENTS

| | | | |
|---|---|---|---|
| 5,072,946 | 12/1991 | Miller | 273/292 |
| 5,265,882 | 11/1993 | Malek | 273/292 |
| 5,275,415 | 1/1994 | Wisted | 273/274 |
| 5,275,416 | 1/1994 | Schorr et al. | 273/292 |
| 5,411,268 | 5/1995 | Nelson et al. | 273/292 |

OTHER PUBLICATIONS

Scarne's Encyclopedia of Games by John Scarne, Harper & Row Publishers, 1973, p. 20.

Win Magazine Apr. 1992, pp. 39, 40 and 70.

*Primary Examiner*—Benjamin H. Layno

*Attorney, Agent, or Firm*—Kenton R. Mullins

[57] ABSTRACT

The method of playing a card game according to the present invention is operated among a plurality of players and a house dealer. The method uses a deck of 32 cards. The 32-card deck is obtained from a conventional 52-card deck with an additional two jokers, and all jack, queen, and king cards removed. Additionally, the six of hearts, six of spades, jack of hearts, jack of spades, ace of hearts, and ace of spades cards are removed. According to the method of the present invention, each player places a wager, and the house dealer deals four cards for each of the players. All of the sets of four cards are placed on the table, in a row, and the house dealer assigns the position of banker to one of the players. The banker then picks one of the eight hands, and roll a set of dice to determine which of the remaining players should receive that hand of four cards. The remaining hands are assigned to the remaining players in an orderly fashion. All of the players' cards are placed face down in an arranged order, except for the banker's hand, which is placed face up in an arranged order. Each player determines the arranged order of his hand. The players' cards are then sequentially compared to the banker's cards, and winners are determined based on the comparison.

20 Claims, 4 Drawing Sheets

METHOD OF PLAYING A CARD GAME

BACKGROUND OF THE INVENTION

1. Field of the Invention

The present invention generally relates to card games and, in particular, to card games utilizing customized decks of cards for use in casinos.

2. Description of Related Art

The Paigow game is considered by some to be one of the most legendary ancient games in the world. Traditionally, this game has been played using "tiles," which are very similar to dominos. Because of the wide range of variations for playing the game and the nature by which the tiles must be read and set, Paigow has not been widely accepted among American card players.

Applicant is aware of several card games which generally can be played in a casino-type environment. U.S. Pat. No. 5,072,946 to Miller discloses a casino-type card game involving two players. A card is dealt to each player, and when the numerical values of the cards are compared, a tie ends the game, or another card is dealt to the player with the lower numerical value hand. The player first reaching a predetermined numerical value eventually wins the game. Another patent, U.S. Pat. No. 5,265,882 to Malek discloses a casino-type card game wherein a player simultaneously plays at least two of three games against the player. This game is applicable to Twenty-One, modified Draw Poker, and Baccarat. U.S. Pat. No. 5,275,415 to Wisted discloses a Blackjack-type game among a plurality of players playing against each other with a player. The dealer, however, does not receive any cards. A final card game to Schorr et al., U.S. Pat. No. 5,275,416, discloses a Blackjack-type card game with at least one customer wagering a first bet on any one of a dealer betting station corresponding to the "dealer hand," a player betting station corresponding to the "player hand," and a tie betting station. None of these games, however, use modified card decks in combination with customized playing rules, as does the present invention.

SUMMARY OF THE INVENTION

The method of playing a card game according to the present invention is operated among a plurality of players and a house dealer. The method uses a deck of 32 cards. The 32-card deck is obtained from a conventional 52-card deck with an additional two jokers, and all jack, queen, and king cards removed. Additionally, the six of hearts, six of spades, jack of hearts, jack of spades, ace of hearts, and ace of spades cards are removed. According to the method of the present invention, each player places a wager, and the house dealer deals four cards for each of the players. All of the sets of four cards are placed on the table in a row, and the house dealer assigns the position of banker to one of the players. The banker then picks one of the eight hands, and roll a set of dice to determine which of the remaining players should receive that hand of four cards.

The remaining hands are assigned to the remaining players in an orderly fashion. All of the players' cards are placed face down in an arranged order, except for the banker's hand, which is placed face up in an arranged order. Each player determines the arranged order of his hand. The players' cards are then sequentially compared to the banker's cards, and winners are determined based on the comparison.

BRIEF DESCRIPTION OF THE DRAWINGS

The objects and features of the present invention, which are believed to be novel, are set forth with particularity in the appended claims. The present invention, both as to its organization and manner of operation, together with further objects and advantages, may best be understood by reference to the following description, taken in connection with the accompanying drawings.

DETAILED DESCRIPTION OF THE PREFERRED EMBODIMENTS

The following description is provided to enable any person skilled in the art to make and use the invention and sets forth the best modes contemplated by the inventor of carrying out his invention. Various modifications, however, will remain readily apparent to those skilled in the art, since the generic principles of the present invention have been defined herein.

Figure 1:
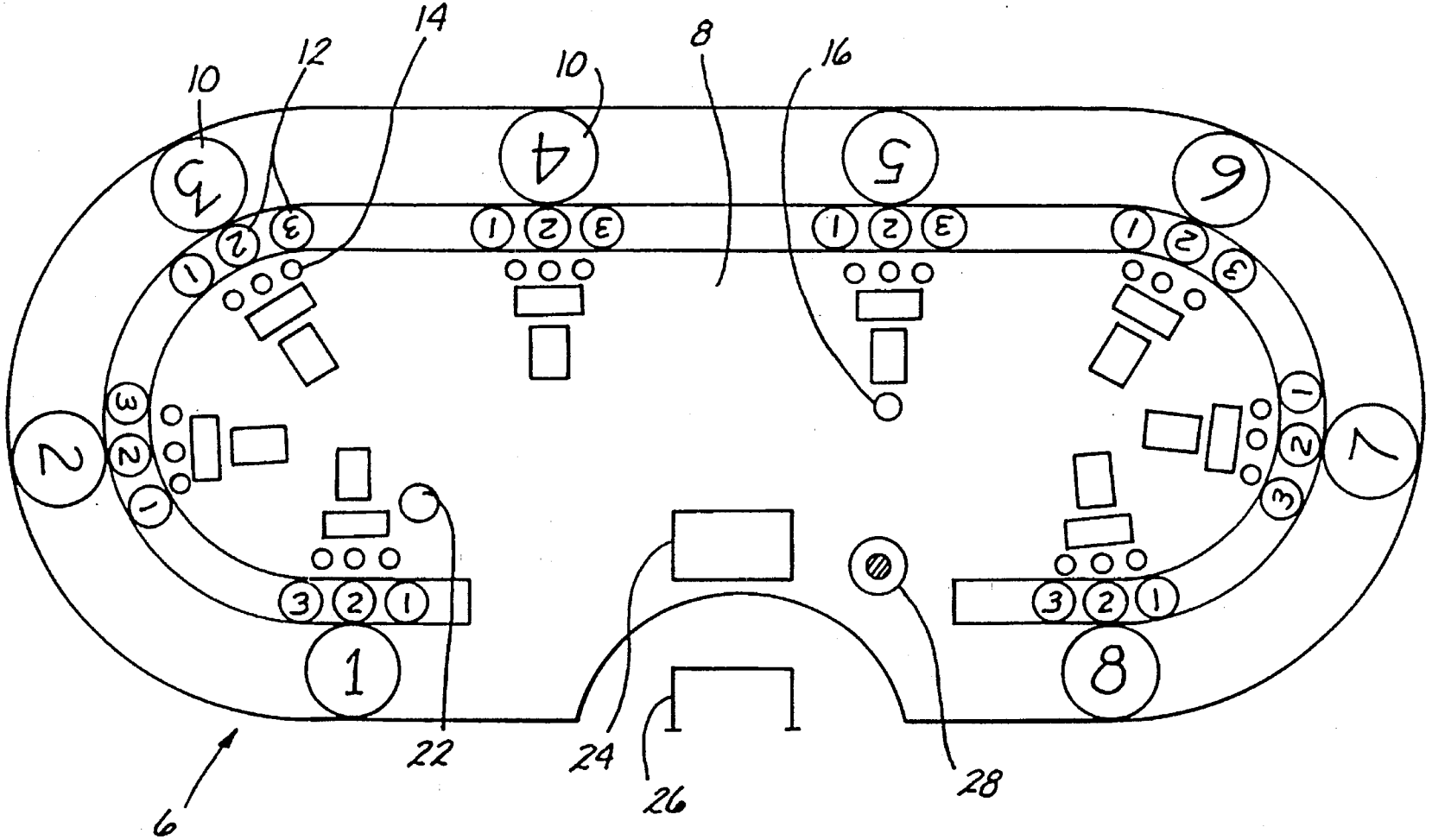
FIG. 1 shows a preferred layout of the card table of the present invention which is used in connection with the method of the present invention.

Turning to FIG. 1, the table 6 of the presently preferred embodiment is shown. The table 6 generally comprises eight player positions 10 positioned about the periphery of the table. A playing surface 8 is located in the center of the table, and a house dealer's position 26 is located between two of the player positions 10.

In the presently preferred embodiment, three wager circles 12 and three collection circles 14 are positioned in front of each player position 10. Additionally, a first tray 18 and a second tray 20 is positioned in each of each player position 10. A bank button 22 can be placed in front of any of the eight player positions to indicate that that player is currently the player. Similarly, an action button is placed in front of a selected player position to indicate that that player will be first to receive cards from the house dealer. The action button 16 further indicates that the selected player will be first to play his hand against the banker's hand. The house dealer's tray 24 is positioned in front of the house dealer's position 26. To the right of the house dealer's position 26 is a cup, a die, and a saucer, as shown by reference number 28.

Figure 2A:
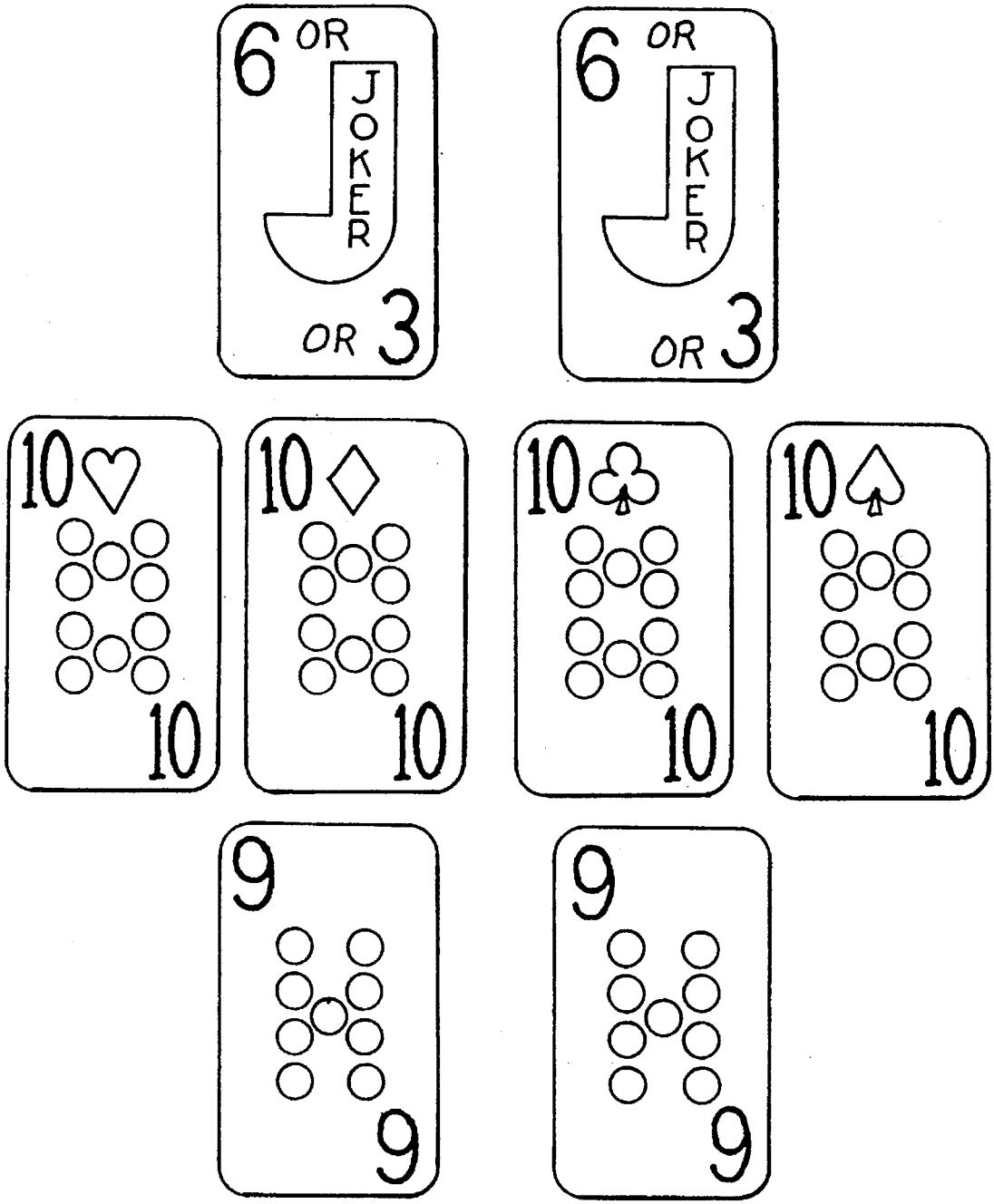
FIGS. 2*a*, 2*b*, and 2*c* show a 32 card deck according to a second preferred embodiment of the present invention.
Figure 2B:
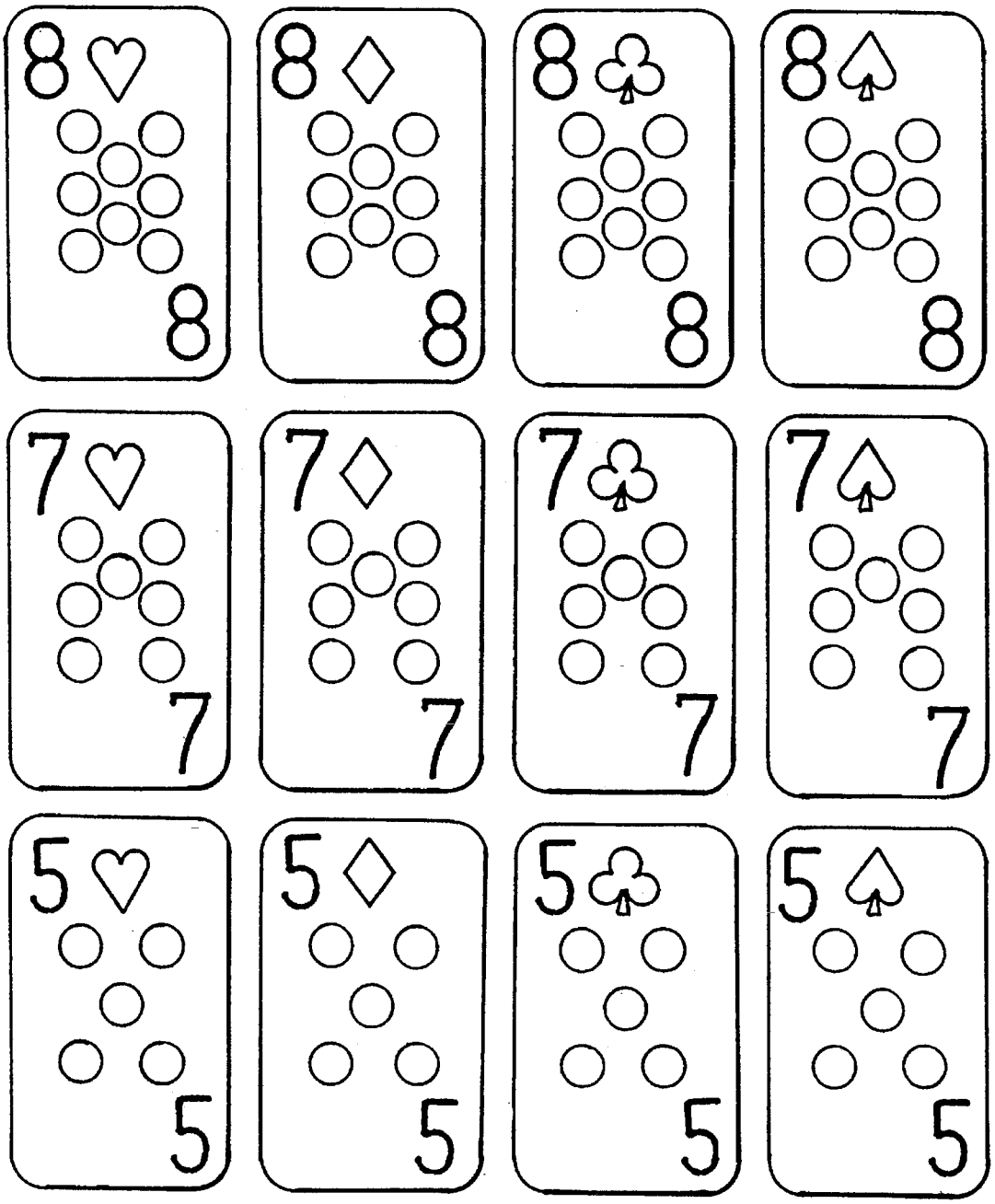
Figure 2C:
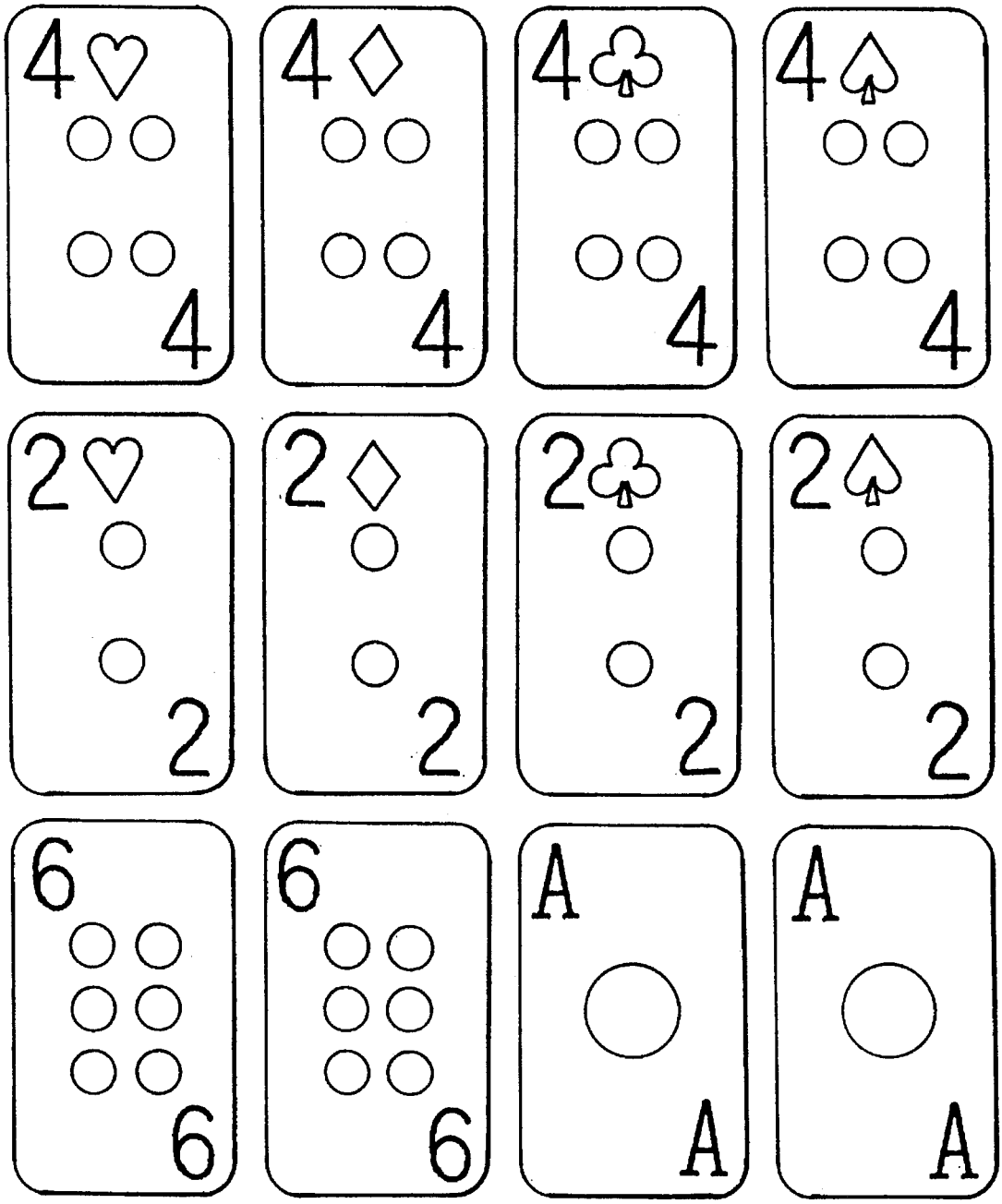

The game embodied by the method of the presently preferred embodiment is referred to as California Paigow, since the customized card deck is made to correspond to tiles used in the original Paigow game to some extent. The customized card deck of the presently preferred embodiment comprises a conventional card deck with two additional jokers. All jacks, queens, and kings are removed from the deck. In addition, all threes, the six of hearts and six of spades, the nine of hearts and nine of spades, and ace of hearts and ace of spades cards are removed. In a second preferred embodiment, a special customized 32 card deck is used, as shown in FIG. 2. The major difference between this deck and a regular deck is that all suit markings are replaced with dots to resemble the appearance of dominos. As mentioned above, the present invention is somewhat based on the original game of Paigow, which uses dominos.

In addition to the customized card deck, a number of assignments of card values are made in implementing the method of the present invention. These value assignments are made to provide a rough correspondence between originally-used tiles and the modified card deck of the present invention. According to this assignment of values, any card of 10 is counted as 0, but two cards of 10 are counted as a pair of 10s. Joker cards can be counted as either six or three, but two joker cards count as a pair of jokers. Other cards are counted as their indicated face value, ignoring the suit. Additionally, aces are counted as one, but two aces are counted as a pair of aces.

The first step of the method of the presently preferred embodiment involves each of the players at player position 10 placing bets in wager circles 12. Each wager circle 12 may accommodate a bet in the range between a table minimum and a table maximum. For example, a wager circle 12 can accommodate chips valuing from $10.00 to $100.00. The collection circles 14 indicate sums charged by the house for placing a bet in a wager circle 12. For example, each collection circle 14 may correspond to a wager circle 12 and may require 1% of the maximum value placed in a wager circle 12. Using the above example, a player placing any bet between $10.00 and $100.00 in a wager circle 12 must place $1.00 in a corresponding collection circle 14.

A game of the method of the present invention generally comprises each of the eight players betting, receiving cards, and comparing those cards. In the presently preferred embodiment, the player at the player position to the immediate left of the house dealer's position 26 begins as banker. This player remains banker for two games. The banker button 22 is then given to the player at player position 10 to the immediate left of the player who was previously banker. This player is banker for two games as well. The banker button thus is assigned to each player at a player position 10 for two games, and rotated one to the left until all eight players have been banker for two games. A round comprises 16 games.

The player with the banker button 22 can bet between $70.00 (which corresponds to the minimum bet for each of the other seven players) and a maximum of $2,100.00 (corresponding to each of the seven players betting $100.00).

After all players have placed their bets for a game, the house dealer at house dealer's position 26 deals cards to each of seven card positions located just in front of the house dealer's tray 24. If fewer players are used, a corresponding fewer number of card positions will be used. If eight players are used, eight card positions will be placed directly in front of the house dealer's tray 24 in the middle of the playing surface 8. These eight card positions will be aligned in a row parallel to a line between card positions opposite the house dealer's position 26. The house dealer begins dealing cards to these card positions from left to right, placing one card in each card position, and then places an additional eight cards in the card positions going from right to left. Another left-to-right pass and a right-to-left pass are made, placing another two cards in each card position, for a total of four cards in each card position.

Next, the house dealer gives the bank button 22 to the player immediately to the right of the house dealer position 26. As previously mentioned, this bank button 22 will rotate around the player positions 10 in clockwise fashion through the progression of games. After the player at the player position to the immediate left of the house dealer's position 26 receives the bank button 22, this player (hereinafter referred to as the "banker") selects one of the eight card positions. The house dealer then hands the cup 28 to the banker and the banker rolls the dice within the cup to generate a number. In the presently preferred embodiment, three dice are used and the number generated is obtained from the sum of the three rolled dice. This generated number is used to select which player receives the action button 16. For example, if the sum of the three dice is five, the fifth player to the left of the house dealer's position 26 receives the action button 16 and the selected hand of four cards.

The remaining cards in the remaining seven card positions are assigned to players from left to right and clockwise, beginning to the left of the player having the action button. Accordingly, each of the eight players receives a hand of four cards from the cards placed in the card positions by the house dealer.

Each player then arranges his hand of four cards into two parts, according to the ranking chart given below. Each part comprises two cards, and the object is to generate the best two combinations for the two parts. Once this is done, each player places a first part in the first tray 18 and a second part in the second tray 20. The first part in the first tray 18 should have a higher ranking than the second part in the second tray 20.

The object of the method of the presently preferred embodiment is to generate two parts, each comprising two cards, with the highest ranks in the ranking chart shown below. As can be seen from the ranking chart, pairs are generally ranked higher than nonpairs, and nonpairs having a sum of nine are preferred over nonpairs having lower sums.

The house dealer holds the banker's four cards, and then opens the four cards to allow all of the players to view their values. The banker can then arrange the four cards into two parts having high combinational values.

Next, the player having the action button 16 opens his cards, and his cards are compared with those of the bankers. To win, both parts of a player's hand must be higher than the banker's parts. If only one part of the player's hand is higher than a part of the banker's, a "push" hand is generated. In such a case, the player is allowed to keep his wager, but the house dealer keeps the chips in the collection circles 14 of that player. If any part between the banker and player have the same ranking, the banker is deemed to have won that part. Accordingly, a player must win both parts over the banker to collect money from the banker. The player can only collect money from the banker to the extent that the banker has wagered chips in wager circles 12. If insufficient funds exist in the wager circles 12, then the winning player can only collect the amount in those wager circles 12. If no funds remain in the wager circles 12 (for example, if a player following the player having the action button 16 later wins), then that player gets his wager back, as well as the collection in the collection circles 14 in front of him. In this event, when no money remains at all in the banker's wager circles 12, all players who have not played yet get the money from the collection circles 14 refunded. This process is referred to as "courtesy time."

The ranking chart below is given in descending order. Thus, the number 1 position (pair of jokers) is given highest ranking, and the sum of two cards being zero is given lowest ranking.

(1) Pair of jokers
(2) Pair of tens
(3) Pair of nines
(4) Pair of eights
(5) Pair of sevens
(6) Pair of sixes
(7) Combination of joker and six (8) Pair of fives
(9) Pair of fours
(10) Pair of twos
(11) Pair of aces
(12) The sum of two cards is nine
(13) The sum of two cards is eight
(14) Combination of joker and two or five
(15) The sum of two cards is seven
(16) Combination of joker and ace or four
(17) The sum of two cards is six
(18) Combination of joker and 10
(19) The sum of two cards is five
(20) the sum of two cards is four
(21) The sum of two cards is three
(22) The sum of two cards is two
(23) The sum of two cards is one
(24) The sum of two cards is zero.

For rankings (13) through (18), any tie between these rankings can be resolved if one of the parts has a joker. In this case, the joker is considered to have a lower ranking.

| PLAYER'S HANDS | THE WAY TO SET HANDS | |
|---|---|---|
| Banker with four cards as: (joker), (2), (A), (4) | 2 ways: (a) (4) + (2) = 6 (joker) + (A) = 7 | (b) (4) + (A) = 5 (joker) + (2) = 8 |
| Player A with four cards as: (5), (10), (4), (2) | 2 ways: (a) (10) + (2) = 2 (5) + (4) = 9 | (b) (10) + (5) = 5 (4) + (2) = 6 |
| Player B with four cards as: (6), (10), (2), (2) | One way: (10) + (6) = (6) (2) + (2) = Pairs of twos | |
| Player C with four cards as: (joker), (10), (8), (A) | Two ways: (a) (joker) + (10) = 6 (8) + (A) = 9 | (b) (joker) + (A) = 7 (8) + (10) = 8 |

An example of the method of the presently preferred embodiment is now provided. A hand consisting of four cards can generally be divided into two parts in many ways. In the example above, a banker's hand comprises a joker, two, ace, and four. These four cards can be arranged into a first part comprising a four and two, for a total of six, and a second part comprising a joker and an ace for a total of seven. Alternatively, the first part can comprise a four and an ace to total five, and a second part can comprise the joker and the two for a total of eight. The first case (a) yields a total of 13 from parts different from the sum of 13 yielded from the second case (b).

Similarly, players A, B, and C are shown in the chart having hands five, ten, four, and two; six, ten, two, and two; and joker, ten eight, and ace; respectively. Player A can arrange his hand into a first set of parts totalling 11 (case (a)) or a second pair of parts totalling 11 (case (b)). The player B can optimally arrange his hand of four cards into only two parts: a first part comprising the ten and six, for a sum of six; and the second part comprising a pair of twos for a pair of twos. Finally, the player C can arrange his hand into two parts totalling 15 in either of two cases, (a) or (b) .

If all the four players in the above example set their hands according to case (a), the banker will push with player A. The banker will also push with players B and C.

If all of the players set their hands according to case (b), the banker wins over player A. The banker will lose to both player B and player C.

If the banker sets his hand according to case (a) and the players set their hands according to case (b), the banker will win over player A. The banker, however, will push with both player B and player C.

As a final approach to the above example, if the banker sets his hand according to case (b) and the players set their hands according to case (a) , the banker will push with player A and lose to both player B and player C.

As mentioned above, the customized deck of the presently preferred embodiment roughly resembles some features of tiles which are used in the original game of Paigow. The chart provided below is an example of the values between two parts (each part comprising two cards) of the method of the presently preferred embodiment and tiles in the original Paigow game.

| VALUE OF TWO CARDS IN CALIFORNIA PAIGOW | TWO TILES IN PAIGOW |
|---|---|
| 1. Pair of jokers | 1/2, 2/4 |
| 2. Pair of tens | 5/5, 5/5 |
| 3. Pair of nines | 4/5, 3/6 |
| 4. Pair of eights | 4/4, 4/4 |

-continued

| VALUE OF TWO CARDS IN CALIFORNIA PAIGOW | TWO TILES IN PAIGOW |
|---|---|
| 5. Pair of sevens | 1/6, 1/6 |
| 6. Pair of sixes | 1/5, 1/5 |
| 7. Combination of joker and six | 1/2, 1/5 |
| 8. Pair of fives | 2.5/2.5 and 2.5/2.5 |
| 9. Pair of fours | 2/2, 2/2 |
| 10. Pair of twos | 1/1, 1/1 |
| 11. Pair of aces | 5/6, 5/6 |
| 12. Total of two cards is nine | 3/6, 4/6 |
| 13. Total of two cards is eight | 5/6, 1/6 |
| 14. Total of two cards is seven | 1/4, 6/6 |
| 15. Total of two cards is six | 1/5, 4/6 |
| 16. Total of two cards is five | 2/2, 5/6 |
| 17. Total of two cards is four | 1/3, 4/6 |
| 18. Total of two cards is three | 1/1, 5/6 |
| 19. Total of two cards is two | 1/1, 4/6 |
| 20. Total of two cards is one | 5/5, 5/6 |
| 21. Total of two cards is zero | 5/5, 4/6 |

Those skilled in the art will appreciate that various adaptations and modifications of the just-described preferred embodiment can be configured without departing from the scope and spirit of the invention. Therefore, it is to be understood that, within the scope of the appended claims, the invention may be practiced other than as specifically described herein.

What is claimed is:

1. A method of playing a card game among a plurality of players and a house dealer, the method comprising the following steps:

(a) providing a deck of 32 cards by modifying a conventional 52-card deck, the conventional 52-card deck being modified by:

(1) adding two joker card's;

(2) removing all jack, queen, and king cards; and (3) removing all three cards, removing only two of the six cards, removing only two of the nine cards and removing only two of the ace cards, to thereby provide the deck of 32 cards;

(b) placing a wager by each of said players;

(c) the house dealer dealing cards to a number of card positions, the number of card positions equalling the number of players, each of the card positions receiving a hand totalling four cards;

(d) the house dealer assigning to a first of the plurality of players a title of banker;

(e) the banker picking one of the hands corresponding to a card position;

(f) providing at least one die to the banker, the banker rolling the dice to determine an assignment of an action button and reception of the picked hand;

(g) assigning to a second player among the plurality of players the action button and the picked hand, the assignment of the action button to the second player being based upon a number generated by the rolling of the dice;

(h) assigning hands that were not picked to players excluding the second player;

(i) each of the plurality of players excluding the banker placing a corresponding hand of cards face down on the table in an arranged order;

(j) the banker's hand being placed face up in an arranged order;

(k) each of the plurality of players excluding the banker turning a corresponding hand assigned to the player face up; and (l) determining whether each player's hand should win over the hand of the banker.

2. The method of playing a card game according to claim 1, wherein the house dealer deals the four rounds among the plurality of players in a rotational fashion.

3. The method of playing a card game according to claim 2, wherein the first round of cards is dealt clockwise, the second round of cards is dealt counterclockwise, the third round of cards is dealt clockwise, and the fourth round of cards is dealt counterclockwise.

4. The method of playing a card game according to claim 1, wherein the first player is given a bank button indicating that the first player is banker.

5. The method of playing a card game according to claim 1, wherein the assigning of hands that were not picked to players occurs in a clockwise rotational fashion, beginning with a hand adjacent to the hand picked by the banker being assigned to a player adjacent to the second player.

6. The method of playing a card game according to claim 1, wherein the house dealer holds the banker's cards until the banker's cards are placed face up.

7. The method of playing a card game according to claim 6, wherein the step of the banker's hand being placed face up in and arranged order includes the following, substep:

the house dealer placing the banker's cards face up; and the banker arranging the banker's cards in an order determined by the banker.

8. The method of playing a card game according to claim 1, wherein the step of each of the players excluding the banker turning a corresponding hand assigned to the player face up comprising the following substeps:

the second player having the action button turning his hand face up; and the remaining players sequentially turning their hands face up, beginning with a player to the left of the second player and progressing in a clockwise fashion.

9. The method of playing a card game according to claim 1, wherein a player with a winning hand takes the banker's wager to the extent of the wager placed by that player with the winning hand.

10. A method of playing a card game among a plurality of players and a house dealer, the method comprising the following steps:

providing a deck of 32 cards obtained by modifying a conventional 52-card deck, wherein the conventional 52-card deck is modified by adding two joker cards, removing all jack, queen, and king cards, removing all three cards, removing only two of the six cards, removing only two of the nine cards and removing only two of the ace cards, to thereby provide the deck of 32 cards;

placing a wager by each of said players;

the house dealer dealing cards to a number of card positions, the number of card positions equalling the number of players, each of the card positions receiving a hand totalling four cards;

the house dealer assigning to a first of the plurality of players a title of banker;

the banker picking one of the hands corresponding to a card position;

providing at least one die to the banker, the banker rolling the dice to determine an assignment of an action button and reception of the picked hand:

assigning to a second player among the plurality of players the action button and the picked hand, the assignment of the action button to the second player being based upon a number generated by the rolling of the dice;

assigning hands that were not picked to players excluding the second player;

each of the plurality of players excluding the banker placing a corresponding hand of cards face down on the table with a front row comprising a first row of two of the four cards and a back row comprising a second row of two of the four cards;

the banker's hand being placed face up in an arranged order;

each of the plurality of players excluding the banker turning a corresponding hand assigned to the player face up; and determining whether each player's hand should win over the hand of the banker.

11. The method of playing a card game according to claim 10, wherein the at least one die provided to the banker comprises three dice.

12. The method of playing a card game according to claim 11, wherein the step of the banker rolling the dice to determine an assigmnent of an action button comprises the following substeps:

the banker placing the dice into a cup;

the banker shaking the cup;

the banker rolling the dice from the cup;

adding numbers displayed on the tops of the three dice; and counting from the banker a number of players to the left of the banker, the second player being the counted number of players to the left of the banker, the counted number being equal to the number displayed on the three dice.

13. The method of playing a card game according to claim 12, the dealer collecting a percent of each player's wager.

14. The method of playing a card game according to claim 10, wherein the step of determining whether each player's hand should win over the hand of the banker comprises the following substeps:

making a first comparison by comparing the first two of the four cards in the front row of the player's hand with a first two of four cards in a front row of the banker's hand, a first outcome of the first comparison providing a winner to the first two cards having, preferably, a higher ranking matching pair of the first two cards and, next, a highest sum of the first two cards;

making a first comparison by comparing the second two of the four cards in the back row of the player's hand with a second two of four cards in a back row of the banker's hand, a second outcome of the second comparison providing a winner to the second two cards having, preferably, a higher ranking matching pair of the second two cards and, next, a highest sum of the second two cards.

15. The method of playing a card game according to claim 14, wherein the player winning both the first outcome and the second outcome results in the player winning the hand, wherein the player winning only one of the first outcome and the second outcome, and the player losing the other of the first outcome and the second outcome, result in a push, wherein the player losing both the first outcome and the second outcome result in the player losing the hand, and wherein the player tieing one of the first outcome and the second outcome results in the banker winning that outcome.

16. A method of playing a card game among a plurality of players and a house dealer, the method comprising the following steps:

(a) providing a deck of 32 cards by modifying a conventional 52-card deck, the conventional 52-card deck being modified by:

(1) adding two joker cards;

(2) removing all jack, queen, and king cards; and (3) removing all three cards, only two of the six cards, removing only two of the nine cards and removing only two of the ace cards, to thereby provide the deck of 32 cards;

(b) placing a wager by each of said players;

(c) the house dealer dealing cards to a number of card positions, the number of card positions equalling the number of players, each of the card positions receiving a hand totalling four cards;

(d) assigning to a first of the plurality of players a title of banker, the banker picking one of the hands corresponding to a card position;

(e) providing at least one die to the banker, the banker rolling the dice to determine an assignment of an action button and reception of the picked hand;

(f) assigning to a second player among the plurality of players the action button and the picked hand, the assignment of the action button to the second player being based upon a number generated by the rolling of the dice;

(g) assigning hands that were not picked to players other than the second player;

(h) each of the plurality of players excluding the banker placing a corresponding hand of cards face down on the table in an arranged order;

(i) the banker's hand being placed face up in an arranged order;

(j) each of the plurality of players excluding the banker turning a corresponding hand assigned to the player face up; and (k) determining whether each player's hand should win over the hand of the banker.

17. The method of playing a card game according to claim 16, wherein the assigning of hands that were not picked to players occurs in a clockwise rotational fashion, beginning with a hand adjacent to the hand picked by the banker being assigned to a player adjacent to the second player.

18. The method of playing a card game according to claim 16, wherein the house dealer holds the banker's cards until the banker's cards are placed face up.

19. The method of playing a card game according to claim 16, wherein the first player is given a bank button indicating that the first player is banker.

20. The method of playing a card game according to claim 16, wherein the step of each of the players excluding the banker turning a corresponding hand assigned to the player face up comprising the following substeps:

the second player having the action button turning his hand face up; and the remaining players sequentially turning their hands face up, beginning with a player to the left of the second player and progressing in a clockwise fashion.

* * * * *